US009017235B2

(12) United States Patent
Khademi

(10) Patent No.: US 9,017,235 B2
(45) Date of Patent: Apr. 28, 2015

(54) STRETCHING AND EXERCISE DEVICE AND METHOD

(75) Inventor: Ehsan Khademi, Chevy Chase, MD (US)

(73) Assignee: oozeeki, Inc., Gaithersburg, MD (US)

( * ) Notice: Subject to any disclaimer, the term of this patent is extended or adjusted under 35 U.S.C. 154(b) by 462 days.

(21) Appl. No.: 13/136,808

(22) Filed: Aug. 11, 2011

(65) Prior Publication Data

US 2012/0040808 A1 Feb. 16, 2012

Related U.S. Application Data

(60) Provisional application No. 61/372,592, filed on Aug. 11, 2010.

(51) Int. Cl.

| | |
|---|---|
| ***A63B 21/02*** | (2006.01) |
| ***A63B 21/055*** | (2006.01) |
| ***A63B 21/00*** | (2006.01) |
| ***A63B 21/002*** | (2006.01) |
| *A63B 23/035* | (2006.01) |

(52) U.S. Cl.

CPC ..... *A63B 21/0557* (2013.01); *A63B 21/00043* (2013.01); *A63B 21/00185* (2013.01); *A63B 21/0023* (2013.01); *A63B 21/1434* (2013.01); *A63B 21/1469* (2013.01); *A63B 23/03508* (2013.01); *A63B 2210/50* (2013.01)

(58) Field of Classification Search

CPC ..... A63B 21/055; A63B 21/0552
USPC ..... 482/79, 121, 122, 124; 601/27
See application file for complete search history.

(56) References Cited

U.S. PATENT DOCUMENTS

| | | | | |
|---|---|---|---|---|
| 2,467,943 | A * | 4/1949 | Mikell, Jr. | 482/79 |
| 4,478,414 | A * | 10/1984 | Molloy | 482/123 |
| 4,728,103 | A * | 3/1988 | Fulton | 482/125 |
| 5,582,579 | A * | 12/1996 | Chism et al. | 601/27 |
| 6,367,083 | B1 * | 4/2002 | November | 2/69.5 |

* cited by examiner

*Primary Examiner* — Loan H Thanh
*Assistant Examiner* — Rae Fischer

(57) ABSTRACT

A stretching and exercise device has a first strap member having a pair of end portions, a second strap member having a pair of end portions, and a pair of resistance members connected between respective end portions of the first and second strap members. A third strap member has a pair of end portions attached to respective first and second surface portions of the second strap member. A fourth strap member is attached to a third surface portion of the second strap member different from the first and second surface portions thereof.

17 Claims, 8 Drawing Sheets

STRETCHING AND EXERCISE DEVICE AND METHOD

CROSS-REFERENCE TO RELATED APPLICATIONS

The present application for patent claims priority benefit of Provisional Application Ser. No. 61/372,592 filed Aug. 11, 2010. This provisional patent application is hereby expressly incorporated by reference herein in its entirety.

BACKGROUND OF THE INVENTION

1. Field of the Invention

The present invention relates generally to fitness and rehabilitation devices, and more specifically to a portable stretching and exercise device that can be used by persons of all ages and skill levels to improve physical wellbeing and minimize risk of injury. The present invention also relates to a method of stretching and exercising using the portable stretching and exercise device.

2. Background Information

It is well established that proper exercise routines help people live longer and healthier lives. To this end, fitness enthusiasts, runners, bicyclists, gymnasts, athletes, frequent travelers, office workers, and low back pain sufferers are encouraged by medical and fitness professionals to stretch to increase flexibility and reduce pain and chances of injuries. The hamstring, hip, calf, and foot muscles and muscles in the lower back area are especially important to keep flexible because these muscle groups tend to tighten as we get older and can cause lower back pain, leg pain, calf pain, foot pain and other injuries.

It has long been known that a precise stretch of muscle tissue results in a muscle relaxation response. A stretch that attains the appropriate angle and degree tends to achieve the goals of relaxation, stimulation, and physical wellbeing. However, although the benefits of precise stretching are clear, it has been difficult for individuals to effectively apply and obtain precision stretching techniques in a reliable and reproducible way, and especially in an independent or unassisted physical therapy or exercise program.

Thus, proper stretching forms and techniques have been difficult to practice and accomplish correctly. Young children may not possess the skill and coordination to stretch properly. Adults engaged in a proper stretching routine often find many of the required bodily positions awkward and difficult to maintain long enough to be effective. Elderly persons often find difficulty in simple stretching techniques. Injured persons in rehabilitation programs may also have similar trouble in accomplishing proper stretching and range of motion exercises.

The ideal stretch requires stretching slowly and gradually, holding each stretch for 10-30 seconds. This allows muscle fibers to stretch to their maximum potential or flexibility, avoiding injury. Many people overstretch the muscles by bouncing which may result in tearing of muscle fibers and ligaments, causing very painful injuries. It has been documented in exercise physiology that "static" stretching (slow, gradual, in stages) is much more effective than "ballistic" (bouncing) stretching.

There are existing stretching devices that treat specific muscles and specific portions of the body, such as various types of lower back and leg stretching devices. However, none has effectively isolated the hamstring muscles from the calf and foot muscle, thus inhibiting the ability to fully stretch and hold the hamstring muscles for an efficient and effective stretch.

Moreover, the bulkiness of existing stretching devices discourages many users to take it on long flights or train rides, gymnasiums, and bicycle or jogging trails to enable proper stretching during a long period of inactivity, or prior to a full work out. Furthermore, the materials used in existing stretching devices may be slippery and difficult to grip or to position on the body. Additionally, various types of existing leg stretching devices have used firm and rigid material jointed by the handles to stretch the muscles, thus creating a stiff pull and unnecessary stress on the targeted muscle group, which could be stressful and further discourage a user from stretching. As a result, the existing stretching devices have not been designed as devices and products that are versatile and are interactively used by a person.

As a result of the foregoing problems with practicing and maintaining proper stretching forms and techniques and the foregoing drawbacks with existing stretching devices, a stretching and exercise device is desired that will aid in stretching and exercising, is comfortable and safe to use, is inexpensive, and has high portability by virtue of being easily stored and transported.

SUMMARY OF THE INVENTION

It is an object of the present invention is to provide a stretching and exercise device via which proper stretching forms and techniques are easily practiced and correctly accomplished.

It is another object of the present invention to provide a stretching and exercise device capable of treating specific muscles and specific portions of the body in an efficient and effective manner.

It is another object of the present invention to provide a stretching and exercise device adapted for lower body muscle stretch, including the user's lower back and legs.

It is a further object of the present invention to provide a stretching and exercise device adapted for isolating and exercising the foot/calf or hamstring/hip muscles of an individual in an efficient and effective manner.

It is a further object of the present invention to provide a stretching and exercise device that utilizes a damping mechanism to soften the stretching motion and minimize the stiffness and discomfort of the pulling during a stretching routine.

It is still a further object of the present invention to provide a stretching and exercise device which facilitates injury prevention, strength training, and/or rehabilitation for foot/leg, hip and lower back muscles.

Yet another object of the present invention is to provide a stretching and exercise device that is that is easy and comfortable to use and is adjustable to body size.

Yet another object of the present invention is to provide a portable, compact stretching and exercise device which is inexpensive to manufacture and can be easily transported and stored.

Still another object of the present invention is to provide a self-packing scheme by which the stretching and exercise device of the present invention packs into a small, portable package or case without the necessity for a separate carrying bag.

The foregoing and other objects of the present invention are carried out by a stretching and exercise device comprising a first strap member having a pair of end portions, a second strap member having a pair of end portions, a pair of resistance members connected between respective end portions of the first and second strap members, a third strap member having a pair of end portions attached to respective first and second surface portions of the second strap member, and a fourth strap member attached to a third surface portion of the second strap member different from the first and second surface portions thereof.

In one aspect of the invention, the first strap member has at least one holding portion that is disposed between the end portions of the first strap member and is configured to be gripped by a user's hand during a stretch exercise. The third strap member is configured to be engaged by the user's ankle or a region of the user's wrist during the stretch exercise. The fourth strap member is configured to be engaged by the user's foot or a region of the user's elbow during the stretch exercise.

In another aspect of the invention, the first, second, third and fourth strap members are formed of a flexible material and the resistance members are formed of an elastic material. Preferably, the first, second and third strap members are formed of tubular nylon webbing, the fourth strap member is made of ballistic nylon, and each resistance members is a bungee cord.

In yet another aspect of the invention, the first and third strap members are formed of a flexible tubular material. A soft filler material is disposed in the third strap member and in the at least one handle portion of the first strap member.

In a further aspect of the invention, a plurality of connectors are provided for connecting the resistance members to respective end portions of the first and second strap members. Preferably, each of the first, second and third strap members is formed of tubular nylon webbing, each of the connectors and the fourth strap member is made of ballistic nylon, and each of the resistance members is a bungee cord.

In a further aspect of the invention, the first, second, third and fourth strap members and the connectors are formed of straps of flexible fabric material stitched together.

In yet a further aspect, the present invention provides a storage case integral with the fourth strap member and dimensioned to receive therein the first, second, third and fourth strap members and the resistance members. The storage case preferably comprises a first lid integrally attached to the fourth strap member and a second lid pivotally attached to the first lid so as to permit complete enclosure of the first, second, third and fourth strap members and the resistance members within the storage case when the second lid is placed over the first lid.

In other aspects, the present invention is directed to methods of exercising various muscles of the user's body using the stretching and exercise device according to the present invention.

BRIEF DESCRIPTION OF THE DRAWINGS

The foregoing summary, as well as the following detailed description of the preferred embodiments of the invention, will be better understood when read in conjunction with the accompanying drawings. For the purpose of illustrating the invention, there is shown in the drawings embodiments which are presently preferred. It should be understood, however, that the invention is not limited to the precise arrangement and instrumentalities shown. In the drawings.

DETAILED DESCRIPTION OF THE PREFERRED EMBODIMENTS

Figure 1A:
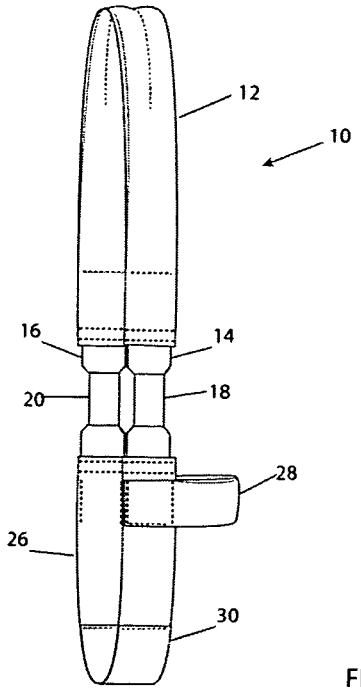
FIG. 1A is a side elevation perspective view of a stretching and exercise device in accordance with a first embodiment of the present invention.

While this invention is susceptible of embodiments in many different forms, this specification and the accompanying drawings disclose only presently preferred embodiments of the invention. The invention is not intended to be limited to the embodiments so described, and the scope of the invention will be pointed out in the appended claims.

Certain terminology is used in the following description for convenience only and is not intended to be limiting. The words right, left, front, top, rear, back, upper, lower, inner, outer, rearwardly and forwardly designate directions in the drawing to which reference is made. Such terminology includes the words above specifically mentioned and words of similar import.

In the following description of the preferred embodiments of the present invention, the term "about" is used to quantify the preferred dimensions, angles and weights of the stretching and exercise device and its components. The term "about" is defined to cover the specific dimensions and weights described as well as values within a range of ±10% of the specific dimensions and weights described.

The preferred embodiments of the stretching and exercise device according to the present invention are described below with specific application to certain stretch exercises, including shoulder, hamstring, calf and hip muscle stretch exercises. However, it will be appreciated by those of ordinary skill in the art that the stretching and exercise device of the present invention is also specifically well adapted for performing other related or different types of stretch exercises, such as arm, foot, leg, and lower back muscle stretch exercises, for example.

Figure 1B:
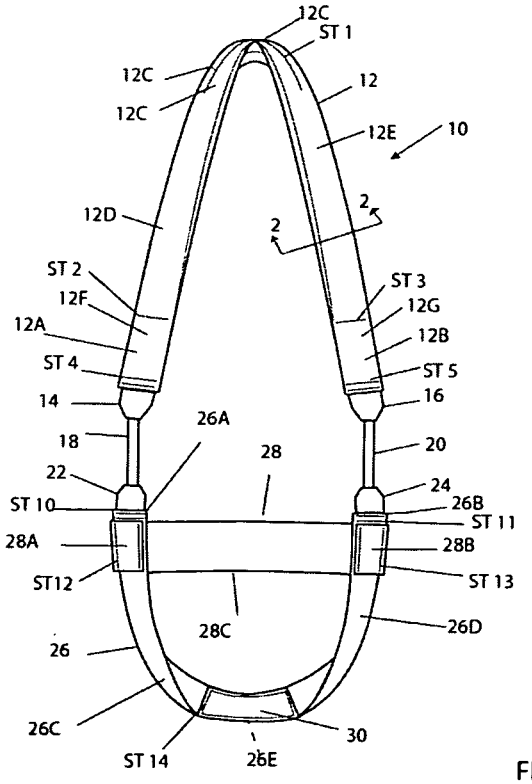
FIG. 1B is a front elevation view of the stretching and exercise device according to the first embodiment of the invention.
Figure 1C:
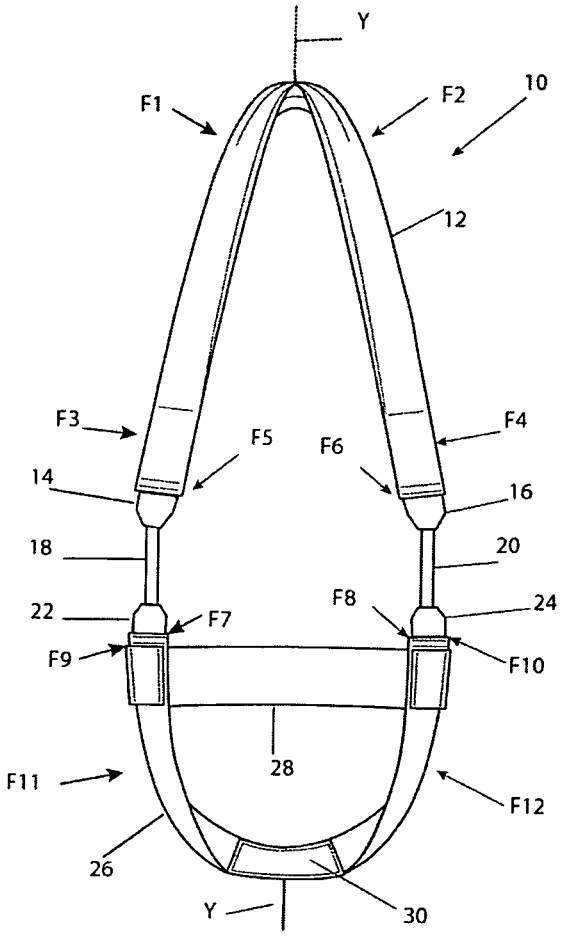
FIG. 1C is a front elevation view illustrating bending/folding points of the stretching and exercise device according to the first embodiment of the invention.

Referring now to the drawings in detail, wherein like numerals are used to indicate like elements throughout, there is shown in FIGS. 1A-1C, 2, 3A-3B and 4-5 a stretching and exercise device ("device"), generally designated at 10, according to a first exemplary embodiment of the present invention. FIGS. 1A and 1B are side and front elevation views, respectively, showing device 10 in an open, generally unfolded state for the purpose of illustrating the various device components and corresponding interconnections and positional relationships. Device 10 in this exemplary embodiment is configured to be folded for storage and transportation in a manner similar to devices 100 and 200 as described below with reference to FIGS. 6A-6B, 7 and 11A-11C. FIG. 1C is view similar to FIG. 1B and shows various folding portions or sections F1-F12 that facilitate folding of device 10 for storage and transportation. It will be appreciated by those skilled in the art that folding portions or sections F1-F12 of device 10 are not the only portions or sections of device 10 capable of being folded. The entire device 10 can be easily and readily collapsed into a compact, folded state for storage and transportation by virtue of its construction and the materials selected for the components of device 10 as further described below. Folding portions or sections F1-F12 further facilitate relative folding of the various components so that device 10 can be readily collapsed for storage and transportation.

As shown in FIGS. 1A-1B, device 10 includes a handle strap 12 (first strap member) having end portions 12A, 12B and strap sections 12C-12G, first connectors 14, 16 connected to respective end portions 12A, 12B of handle strap 12, elastic resistance members 18, 20 having first end portions connected to respective first connectors 14, 16, second connectors 22, 24 connected to respective second end portions of resistance members 18, 20, a connecting strap 26 (second strap member) having end portions 26A, 26B connected to respective connectors 22, 24 and having strap sections 26C-26E, a first resting strap 28 (third strap member) having end portions 28A, 28B connected to respective surface portions of connecting strap sections 26C, 26D and having a strap section 28C between end portions 28A, 28B, and a second resting strap 30 (fourth strap member) connected to connecting strap section 26E. By this construction, it will be appreciated that resistance members 18, 20 are connected between handle strap 12 and connecting strap 26 via connectors 14, 16 and 22, 24.

Each of handle strap 12, connectors 14, 16, 22, 24, connection strap 26, first resistance strap 28, and second resting strap 30 is made of a durable, high-strength, high-resistance material. In the present embodiment, handle strap 12, connecting strap 26 and first resting strap 28 are preferably made of a natural or synthetic flexible material such as tubular nylon webbing. Connectors 14, 16, 22, 24 and second resting strap 30 are preferably made of a stronger, more abrasion resistant material, such as ballistic nylon. Resistance members 18, 20 are formed of an elastic material such as rubber or rubber-like material having a predetermined level of elasticity corresponding to the amount of pulling force needed to stretch the resistance member a certain distance. Preferably, each resistant member 18, 20 is a bungee cord of preselected length, strength, and degree of elasticity. As recognized in the art, bungee cord is formed of a stretchable fabric, such as nylon, over an elastomeric cord made of natural or synthetic rubber.

Figure 2:
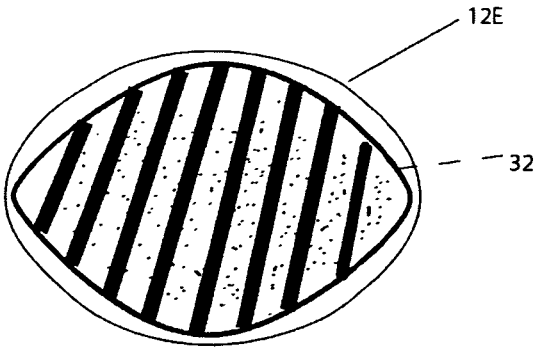
FIG. 2 is a cross-sectional view taken along line 2-2 in FIG. 1B.

Strap sections 12C-12D of handle strap 12, which has a tubular construction, serve as handle portions configured to be gripped by a user's hand during a stretch exercise using device 10, as further described below with reference to FIGS. 4-5. FIG. 2 is a cross-sectional view taken along line 2-2 in FIG. 1B that cuts through strap section 12E of handle strap 12. Although not shown, it will be appreciated that strap sections 12C and 12D have a construction in cross-section similar to that shown in FIG. 2 for strap section 12E. As shown in FIG. 2, tubular strap sections 12C, 12D and 12E are filled with a soft, compressible filler material 32 which provides sufficient firmness and stiffness so that strap sections 12C-12E do not sag or droop while providing a padding for comfort when held by the user's hand during a stretch exercise. Examples of filler material 32 that may be used include synthetic foam rubber, polyester fibers, and the like. According to a feature of the present invention, only strap sections 12C-12E of handle strap are filled with filler material 32. That is, strap sections 12F, 12G are not filled with filler material 32 and thus define bending or folding sections F3, F4 of device 10, as shown in FIG. 1C, which facilitate folding of strap sections 12D, 12E relative to strap sections 12F, 121G to allow device 10 to be easily and readily collapsed into a folded state for storage and transportation.

Referring to FIGS. 1B-1C, handle strap 12 is divided into strap sections 12C-12E using any suitable technique, such as by sewing or stitching, taping, heat sealing and adhesion or other suitable technique or combination of techniques. In the present embodiment, strap section 12C is formed by stitching ST1 that is sewn completely through the tubular material and filler material 32 so that the tubular material is sewn to itself. Stitching ST1 extends along a generally central longitudinal direction of strap section 12C to form section portions 12C1, 12C2. Strap sections 12D, 12E extend from respective opposite end portions of strap section 12C corresponding to respective ends of stitching ST1 so that portions of handle strap 12 between strap section 12C and corresponding strap sections 12D,12E are not filled with filler material 32 and thus define bending or folding portions F1, F2, as shown in FIG. 1C, that facilitate folding of strap sections 12C-12E relative one another. Strap sections 12F, 12G extend from respective end portions of strap sections 12D, 12E and are separated by respective stitching ST2, ST3 that are sewn completely through the tubular material (i.e., strap sections 12F, 12G are not filled with filler material 32 as described above) so that the corresponding tubular material is sewn to itself.

By this construction, strap section 12C serves as a handle portion configured to be gripped by a user's hand during a stretch exercise using device 10 (FIG. 4) and strap sections 12D, 12E serve as handle portions configured to be gripped by both hands of the user during a stretch exercise using device 10 (FIG. 5), as further described below with reference to FIGS. 4-5. Additionally, folding portions F1-F4 of handle strap 12 as described above with reference to FIG. 1C allow strap sections 12C-12G to be easily and readily folded relative one another to facilitate storage and transportation of device 10.

Figure 3A:
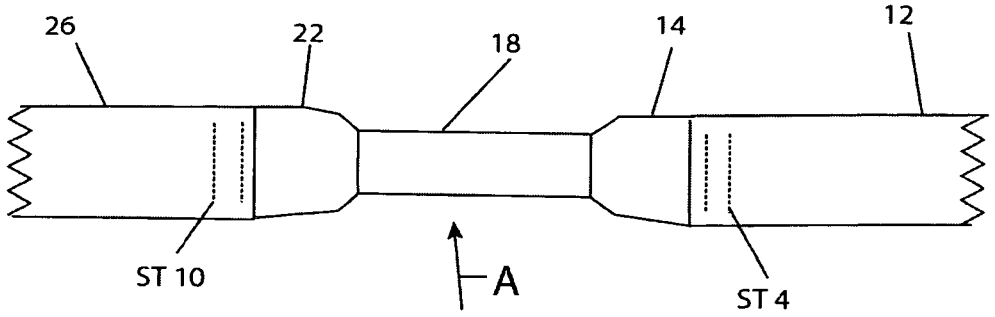
FIG. 3A is a partial side view showing the manner of attachment of one of the elastic straps to the handle strap and connecting strap in the stretching and exercise device according to the first embodiment of the invention.
Figure 3B:
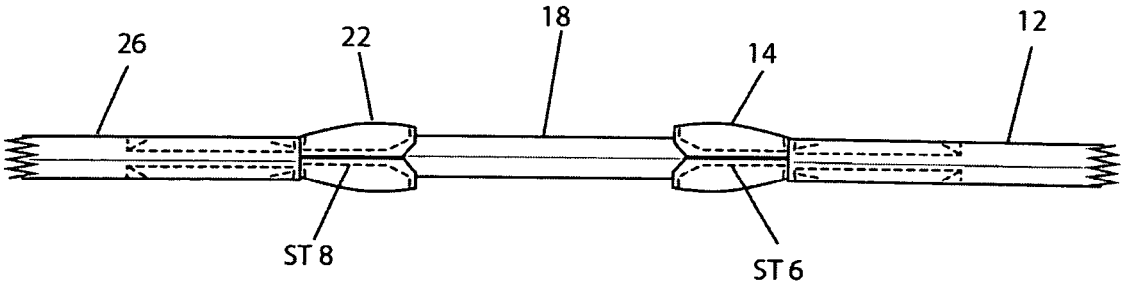
FIG. 3B is an edge-side view in the direction of arrow A in FIG. 3A.

FIGS. 1A-1C and 3A-3B show the manner of connecting resistance members 18, 20 between handle strap 12 and connecting strap 26 via connectors 14, 16 and 22, 24. FIG. 3A is an enlarged partial side view and FIG. 3B is an edge-side view in the direction of arrow A in FIG. 3A showing the specific connection of resistance member 18 between handle strap 12 and connecting strap 26 via connectors 14, 22. Connector 14 is a strap of material folded to provide a folded edge that extends into the tubular end portion 12A of handle strap 12 and is securely connected directly to end portion 12A of handle strap 12 by stitching ST4 that extend completely through the tubular material of handle strap 12 and the material of connectors 14 so that these materials are sewn to themselves and to each other. A first end portion of resistance member 18 is inserted between the folded material of connector 14 and is connected to connector 14 by stitching ST6 along peripheral edges of connector 14 to firmly secure the first end portion of resistance member 18 to connector 14.

It will be appreciated that in the exemplary embodiment shown in FIGS. 1A-1C and 3A-3B, the first end portion of resistance member 18 is not secured directly to and does not contact end portion 12A of handle strap 12. That is, in the connected state between end portion 12A of handle strap 12, connector 14 and the first end of resistance member 18, a space exists within a portion of the folded material of connector 14 and between the first end portion of resistance member 18 and end portion 12*a* of handle strap 12. This space defines a folding portion F5, as shown in FIG. 1C, that further facilitates folding of device 10 for storage and transportation.

As shown in FIGS. 1A-1C and 3A-3B, the connection between connector 22 to end portion 26A of connecting strap 26 is the same as described above for connector 14 and end portion 12A of handle strap 12 and is achieved by stitching ST10. The connection between the second end of resistance member 18 and connector 22 is the same as described above for the first end of connector member 18 and connector 14 and is achieved by stitching ST8. Similar to the first end portion of resistance member 18, the second end portion of resistance member 18 is not secured directly to and does not contact the end portion 26A of connection strap 26. That is, in the connected state between end portion 26*a* of connection strap 26, connector 22 and the second end portion of resistance member 18, a space exists within a portion of the folded material of connector 22 between the second end portion of resistance member 18 and end portion 26*a* of connection strap 26. This space defines a folding portion F7, as shown in FIG. 1C, which further facilitates folding of device 10.

By the foregoing construction, resistance member 18 is securely connected between end portion 12A of handle strap 12 and end portion 26A of connecting strap 26 via respective connectors 14, 22. Additionally, folding portions F5, F7 facilitates folding of handle strap 12 and connecting strap 26 relative to one another and to connectors 14, 22 and resistance member 18, thereby further facilitating collapsing of device 10 into a folded state for storage and transportation.

The secure connection of resistance member 20 between end portion 12B of handle strap 12 and end portion 26B of connecting strap 26 via respective connectors 16, 24 is accomplished in a manner similar as described above for handle strap 12, connecting strap 26, connectors 14, 22 and resistance member 18. In this regard, connector 16 is secured to end portion 12B of handle strap 12 by stitching ST5 and a first end of resistance member 20 is secured to connector 16 by stitching (not shown) similar to stitching ST6 as shown in FIG. 3B. Connector 24 is secured to end portion 26B of connection strap 26 by stitching lines ST11 and a second end of resistance member 20 is secured to connector 24 using stitching (not shown) similar to stitching ST8 as shown in FIG. 3B. As shown in FIG. 1C, folding portions F6, F8 are provided for the connection of resistance member 20 between handle strap 12 and connection strap 26 similar to folding portions F5, F7 described above for the connection of resistance member 18 between handle strap 12 and connection strap 26.

As described above, end portions 26A, 26B of connecting strap 26 are securely connected to respective connectors 22, 24 via stitching ST10, ST11, respectively. Like handle strap 12, connecting strap 26 is also preferably made of tubular nylon webbing. However, unlike handle strap 12, connecting strap 26 does not contain any portions or sections filled with a filler material. Strap sections 26C, 26D of connecting strap 26 have respective end portions 26A, 26B, and strap section 26E of connecting strap 26 is located between strap sections 26C, 26D and defines a generally central section of connecting strap 26.

Referring back to FIGS. 1A-1C, resting strap 28 has end portions 28A-28B and a strap section 28C and extends between connecting strap sections 26C, 26D. Strap section 28C provides a resting place for the user's arm or ankle during a corresponding stretching exercise as further described below with reference to FIGS. 4-5. End portions 28A, 28B of first resting strap 28 are securely connected to respective surface portions of connecting strap sections 26C, 26D by stitching ST12, ST13. End portions 28A, 28B are positioned on connecting strap sections 26C, 26D at respective spaced-apart distances from stitch lines ST10, ST11 to form folding portions F9, F10, as shown in FIG. 1C, which further facilitate bending or folding of handle strap 12, connectors 14, 16, 22, 24, resistance members 18, 20 and connector strap 26 relative to first resting strap 28. Strap section 28C of first resting strap 28 extends between end portions 28A, 28B and is filled with a filler material similar to filler material 32 described above for strap sections 12C-12E of handle strap 12. By this construction, strap section 28C of first resting strap 28 provides comfortable support as a resting place for the user's arm (FIG. 4) or ankle (FIG. 5) during stretch exercises.

Second resting strap 30 is disposed over central strap section 26E and provides a resting place, as well as the requisite traction and comfort, for the user's elbow (FIG. 4) or foot (FIG. 5) during a corresponding stretching exercise. Second resting strap 30 is formed of a strap of material folded over and secured to strap section 26E by stitching ST14 extending completely through the materials of second resting strap 30 and strap section 26E so that the materials for second resting strap 30 and strap section 26E are sewn to themselves and to each other. Preferably, second resting strap 30 is made of a durable, abrasion resistant, high-strength material, such as ballistic nylon. It will be appreciated by those skilled in the art that other materials are suitable for second resting strap 30 so long as the selected material provides sufficient traction while being comfortable to the user's elbow or foot during a stretching exercise. For example, second resting strap 30 can be alternately made of textured polyvinyl chloride (PVC).

It will be appreciated from the open, unfolded states shown in FIGS. 1B-1C that device 10 is configured so that it is substantially symmetrical about a central longitudinal axis Y (FIG. 1C). This symmetrical configuration facilitates cradling by device 10 of specific parts of the user's arm (FIG. 4) and ankle and foot (FIG. 5) which enables the user to effectively perform stretching exercises correctly in a reliable and reproducible way.

The dimensions of the above-described components forming stretching and exercise device 10 according to the first embodiment of the present invention are selected to conform to and/or accommodate a specific user or group of users. In one exemplary embodiment, handle strap 12, connecting strap 26 and first resting strap 28 are formed of nylon tubular webbing about 2 inches wide and with respective lengths, in the assembled state shown in FIGS. 1A-1C, of about 28 inches, 16 inches and 10.5 inches. Each resistance member 18, 20 is preferably a bungee cord about 1 inch in width and with a length extending between the corresponding pair of connectors 14, 22 and 16, 24 of about 2 inches. In this exemplary embodiment, device 10 weighs about 5.3 ounces.

Figure 4:
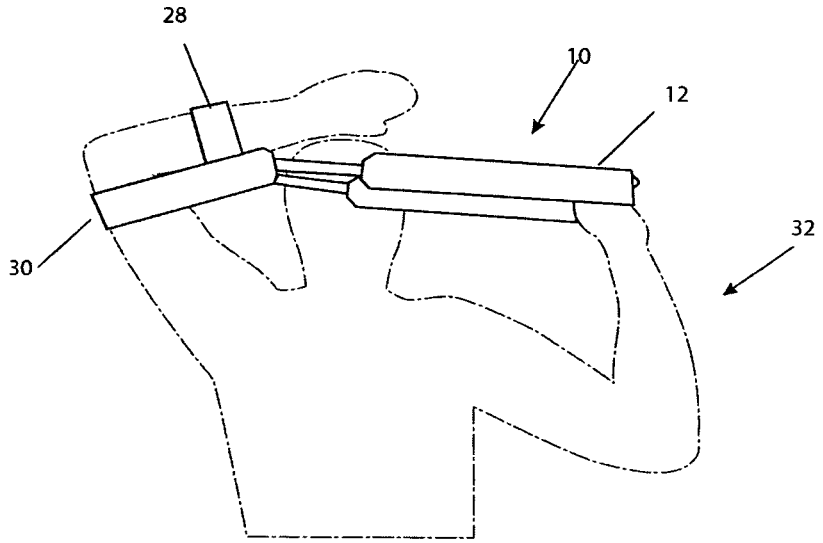
FIG. 4 is a schematic view showing a left shoulder muscle stretch exercise using the stretching and exercise device of the first embodiment of the invention.

FIG. 4 is a schematic view showing a user, generally designated at 32, performing a left shoulder muscle stretch exercise using stretching and exercise device 10 according to the first embodiment of the invention. User 32 places device 10 over the left elbow and behind the neck by gripping strap section 12C of handle strap 12 with the right hand and positioning device 10 so that a portion of the left arm proximate the wrist rests on first resting strap 28 and a portion of the arm proximate the elbow engages second resting strap 30. In this position, handle strap 12 is pulled with the left hand while generating resistance with the left hand via resistance members 18, 20 and while guiding device 10 behind the neck for a full stretch of the left shoulder.

Figure 5:
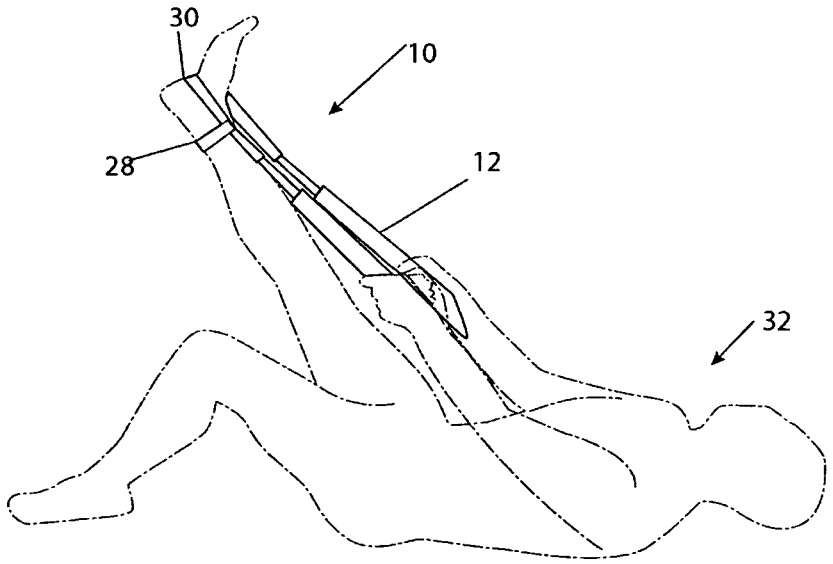
FIG. 5 is a schematic view showing a hamstring and hip muscle stretch exercise using the stretching and exercise device of the first embodiment of the invention.

FIG. 5 is a schematic view showing user 32 performing a hamstring and hip muscle stretch exercise using stretching and exercise device 10 according to the first embodiment of the invention. User 32 positions the right foot so that the sole engages the second resting strap 30 and the ankle rests on first resting strap 28. Thereafter, while laying down, user 32 grips strap sections 12D, 12E of handle strap 12 with both hands and pulls up the right leg to obtain a stretch of the right hamstring and hip muscles. By varying the angle of the pull, user 32 can also stretch the lateral and medial muscles of the leg. It will be appreciated that the foregoing damping effect is applicable to all muscles of the body that can be stretched using device 10, including but not limited to all upper leg muscles, all lower leg muscles, all upper and lower arm muscles, and all shoulder muscles.

In the foregoing stretching exercises illustrated in FIGS. 5-6 using stretching and exercise device 10 according to the first embodiment of the invention, resistance members 18, 20 advantageously soften and smoothen the stretching motion and provide a dampening effect for a smoother, more effective stretch exercise. More specifically, resistance members 18, 20, which extend between handle strap 12 and connecting strap 26, allow for a mild stretch of device 10 so that as user 32 pulls handle strap 12 to stretch, the end of the stretch is softened to thereby reduce overall pain and tension. Additionally, resistance straps 18, 20 allow user 32 to push in with the elbow (FIG. 4) or foot (FIG. 5) into device 10 during a stretch exercise. After several seconds of using device 10, user 32 relaxes and returns to the stretch. This series of events fools the natural stretch reflex of the human body. The stretch reflex is a naturally built defense mechanism of the nervous system that prevents over-stretching of muscles while at the same time limiting the stretch range. Thus resistance members 18, 20 define damping means for softening the stretching motion and minimizing stiffness and discomfort of the pulling action during a stretching routine.

It will be appreciated from the construction of device 10 that during the stretch exercise shown in FIG. 5, the first and second resting straps 28, 30 are disposed at an angle relative to one another in which the ankle and foot are cradled to facilitate a stretching that isolates the hamstring and hip muscles from the calf muscles. Preferably, the angle between first and second resting straps 28, 30 during the stretch exercise shown in FIG. 5 is in the range of about 50 degrees to about 130 degrees, and more preferably about 90 degrees.

By the foregoing construction and operational modes, the stretching and exercise device 10 according to the exemplary embodiment shown in FIGS. 1-5 allows users to effectively perform stretching exercises correctly in a reliable and reproducible way. Additionally, stretching of hamstring and hip muscles usually requires the user to secure the assistance of another person. It will be appreciated by those skilled in the art that while performing the stretching exercise shown in FIG. 5, for example, device 10 allows user 32 to effectively stretch hamstring and hip muscles without any assistance. Thus, stretching and exercise device 10 according to the present invention is particularly suitable for performing stretching exercises independently, such as in an unassisted physical therapy or exercise program.

Figure 6A:
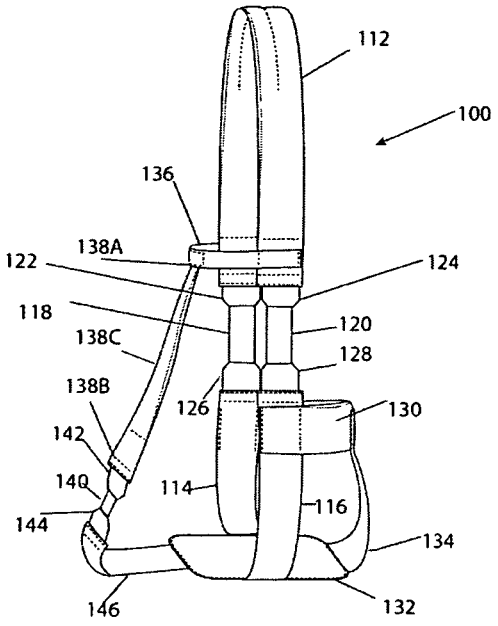
FIG. 6A is a side elevation perspective view of a stretching and exercise device in accordance with a second embodiment of the present invention.
Figure 6B:
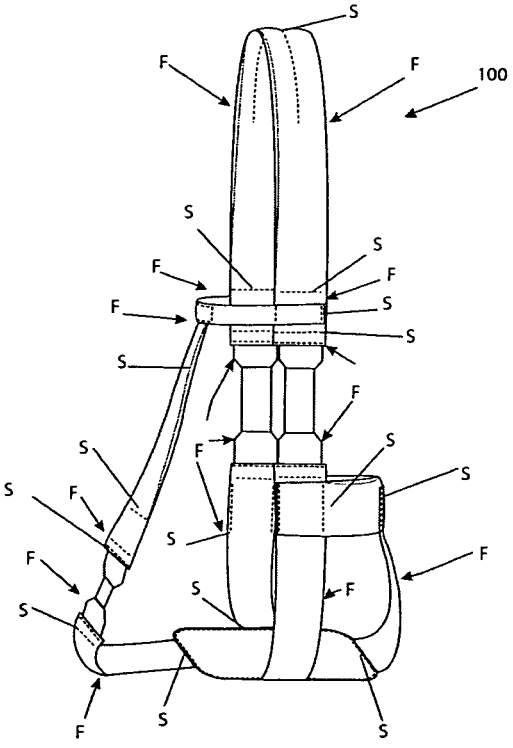
FIG. 6B is a view similar to FIG. 6A and illustrating stitch lines and bending/folding points of the stretching and exercise device according to the second embodiment of the invention.

FIGS. 6A-6B are side elevation perspective views of a stretching and exercise device, generally designated at 100, in accordance with a second embodiment of the present invention. As shown in FIG. 6A, device 100 includes a handle strap 112, connecting straps 114, 116, first resistance members 118, 120, connectors 122, 124, 126, 128, a resting strap 130, a resting strap 132, a connecting strap 134, a connecting strap 136, a handle strap 138C, a resistance member 140, connectors 142, 144, and a connecting strap 146.

The materials and construction of handle strap 112 and corresponding strap sections, including the use of a filler material and stitching and formation of folding portions, are as described above for handle strap 12 in the embodiment of FIGS. 1-5. First end portions of handle strap 112 are connected to respective first end portions of connecting straps 114, 116 via resistance members 118, 120 and connectors 122, 124, 126, 128. The materials and construction of resistance members 118, 120 and connectors 122, 124, 126, 128, and the manner of connection between these components and to first end portions of handle strap 112 and connecting straps 114, 116 are the same as described above for the embodiment of FIGS. 1-5 in connection with resistance members 18, 20, connectors 14, 16, 22, 24, handle strap 12 and connecting strap 26. Second end portions of connecting straps 114, 116 are secured directly to resting strap 132. The foregoing connections are achieved by stitching and form folding points are formed in a manner similar as described above for the embodiment of FIGS. 1-5. FIG. 6B illustrates the various stitching S and folding points F corresponding to the second embodiment of the present invention.

The materials and construction of resting strap 130, including filler material, and the manner of securing resting strap 130 to connecting straps 114, 116 is as described above for resting strap 28 and corresponding connection to strap sections 26C, 26D of connecting strap 26 in the first embodiment shown in FIGS. 1-5, with corresponding stitching S and folding points F shown in FIG. 6B. Connecting strap 134 connects a generally central portion of resting strap 130 to resting strap 132 via corresponding stitching S.

Connecting strap 136, handle strap 138 and connecting strap 146 are also preferably made of tubular nylon webbing. Connecting strap 136 has end portions secured to respective surface portions of handle strap 112 by stitching S. Handle strap 138 has a first end portion 138A secured using stitching S to a generally central portion of connecting strap 136 and a second end portion 138B secured by stitching S to connecting strap 146 via resistance member 140 and connectors 142, 144. Handle strap 138 serves as a handle portion configured to be gripped by a user's hand during a stretch exercise using device 100, as further described below with reference to FIG. 8. A portion 138C of handle strap 138 that is gripped by the user during a stretching exercise is filled with a filler material as described above for the strap sections of handle strap 112.

The construction and materials for resistance member 140 and connectors 142, 144, and the manner of securing the resistance member 140 to connectors 142, 144, are as described above for resistance members 18, 20 and connectors 14, 16, 22, 24 in the embodiment of FIGS. 1-5. Likewise, the manner of securely connecting connector 142 to end portion 138B of handle strap 138 and the manner of securely connecting connector 144 to the end portion of connecting strap 146 are as described above for the connection between connector 16 and end portion 12*a* of handle strap 12 and for the connection between connector 22 and end portion 26*a* of connecting strap 26 in the embodiment of FIGS. 1-5. Stitching S connecting the foregoing components as described above and folding lines F formed by this construction are shown in FIG. 6B.

As described above, in the second embodiment shown in FIGS. 6A-6B, handle strap 112, connecting straps 114, 116, resting strap 130, connecting strap 134, connecting strap 136, handle strap 138, and connecting strap 146 are preferably made of tubular nylon webbing. Connectors 122, 124, 126, 128, 142, 144 and resting strap 132 are preferably made of ballistic nylon. However, it is understood that other materials exhibiting high-resistance, high-strength and durability are suitable for these components without departing from the spirit and scope of the invention. Likewise, resistance members 118, 120 and resistance member 140 are preferably bungee cords of preselected length, strength, and degree of elasticity. It is also understood, however, that other types of elastomeric cords exhibiting the required degree of resistance and elasticity are also suitable for use as the resistance members.

FIGS. 7-11C show a third embodiment of a stretching and exercise device, generally designated at 200, according to the present invention. Device 200 has the same structure as described above for device 100 in the embodiment of FIGS. 6A-6B. Additionally, device 200 incorporates a self-packing feature by integrating device 100 with a packing or storage case or housing 220 configured to store device 100. Housing 220 is securely connected to resting strap 132 and, together with resting strap 132, provides a base or resting place for the user's foot during stretching exercises as further described below with reference to FIGS. 8-9.

Figure 7:
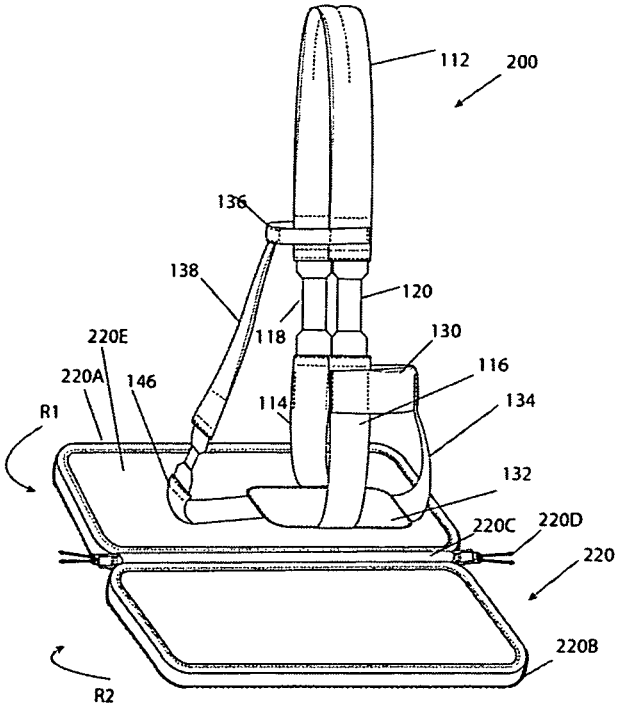
FIG. 7 is a side elevation view of a stretching and exercise device in accordance with a third embodiment of the present invention.
Figure 9:
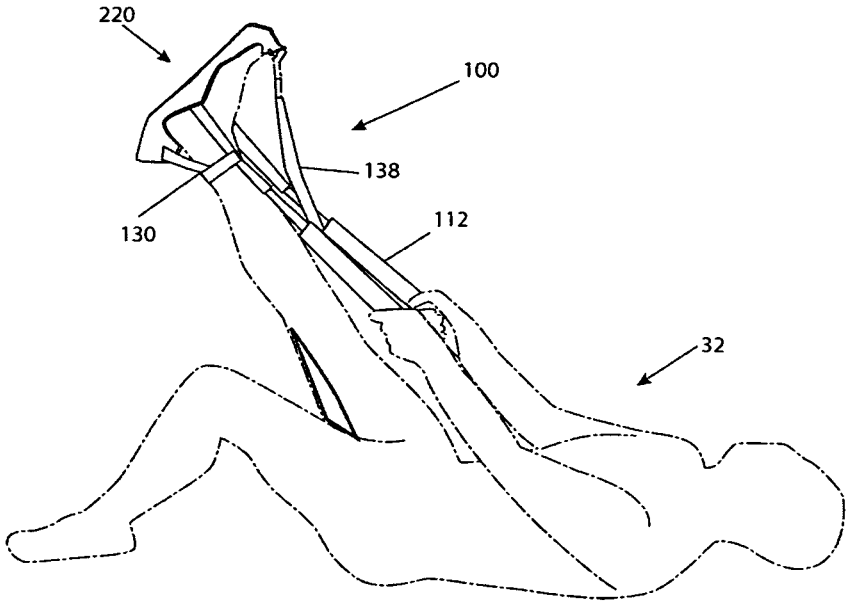
FIG. 9 is a schematic view showing a right hamstring stretch using the stretching and exercise device of the third embodiment of the invention.
Figure 10:
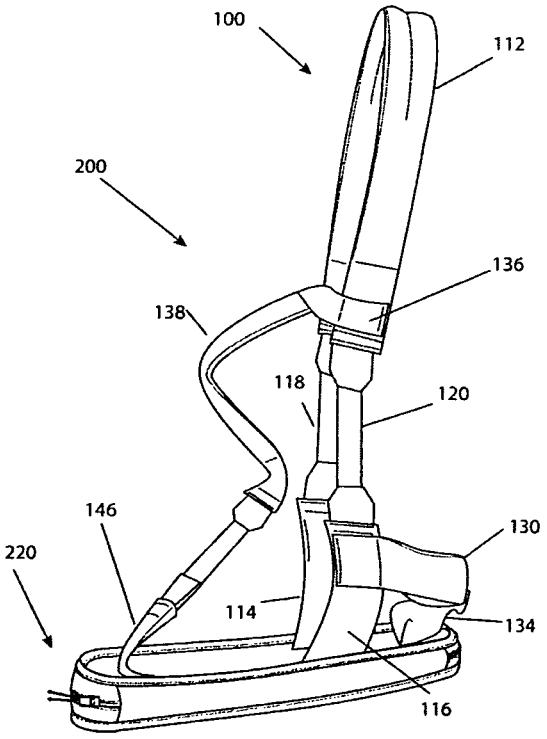
FIG. 10 is a side elevation view of the stretching and exercise device according to the third embodiment of the invention in a state ready for use to perform stretch exercises.
Figure 11A:
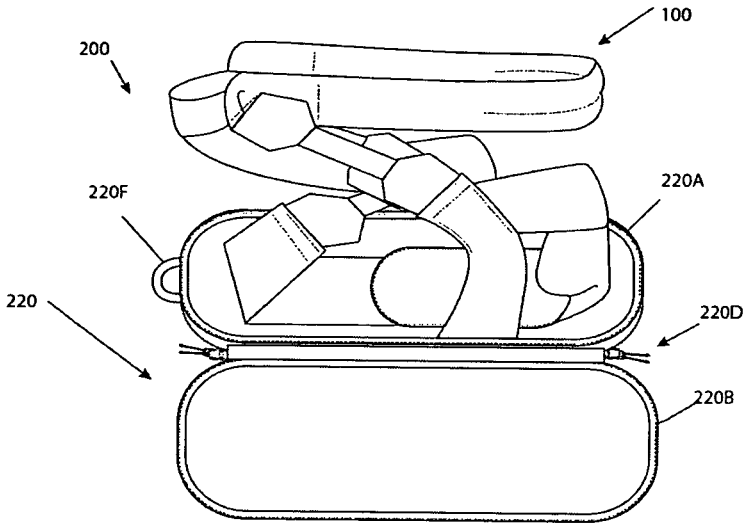
FIGS. 11A-11C are perspective views of a sequence of folding and storing states illustrating the self-packing feature of the stretching and exercise device in accordance with the third embodiment of the present invention.
Figure 11B:
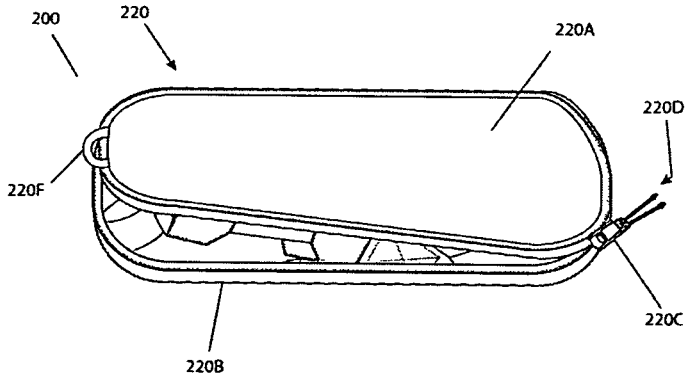
Figure 11C:
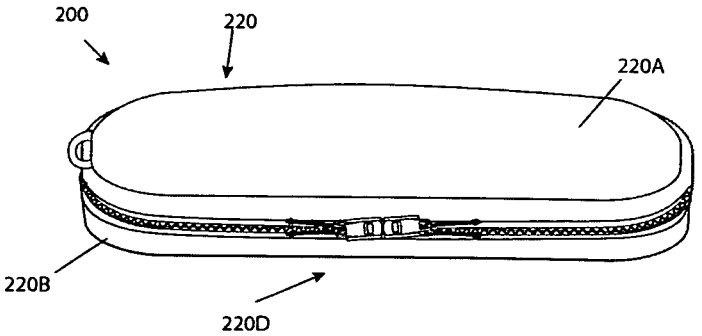

FIGS. 7 and 10 are perspective views of the self-packing stretching and exercising device 200 in open configurations in which device 100 is not stored in housing 220. FIGS. 11A-11C illustrate sequence of steps during which device 100 is stored in housing 220, from a partially stored state in FIG. 11A to a fully stored state in FIG. 11C. As shown in these figures, housing 220 includes lids 220A, 220B connected via a connecting portion 220*c* along marginal portions of lids 220A, 220B, and a reversible, double-zipper system (hereinafter "zipper"), denoted generally at 220D, for selectively opening/closing lids 220A, 220B. This particular construction of zipper 220D allows lids 220A, 220B to be closed in a configuration shown in FIG. 11C, in which device 100 is fully stored within case 220. Alternatively, the construction of zipper 220D allows lids 220A, 220B to be closed in the configuration shown in FIG. 10 by folding lids 220A, 220B in directions of arrows R1, R2, respectively, shown in FIG. 7. In FIG. 10, device 100 is not stored within housing 220 and device 200 is in an open state for performing stretching exercises as shown in FIGS. 8-9.

The resting strap 132 and a portion of connecting strap 146 are securely connected to surface 220E of lid 220A by stitching S. Housing 220, including lids 220A, 220B, is preferably substantially made of the same durable, high-strength material as the resting strap 132, such as ballistic nylon. By this construction, surface 220E of lid 220A and resting strap 132 provide a base or resting place with sufficient traction for the user's foot during stretching exercises such as described below with reference to FIGS. 8-9.

Figure 8:
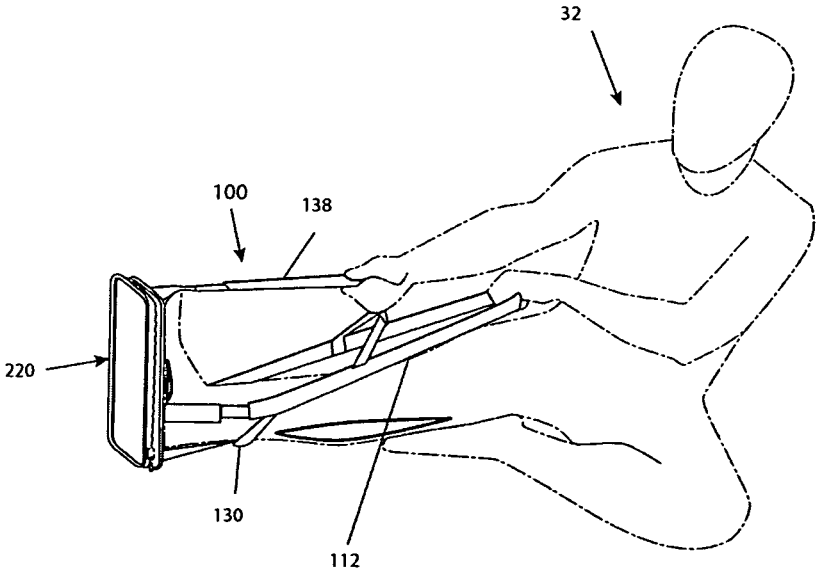
FIG. 8 is a schematic view showing a right calf stretch using the stretching and exercise device of the third embodiment of the invention.

FIG. 8 is a schematic view showing a right calf stretch using stretching and exercise device 200 of the third embodiment of the invention. FIG. 9 is a schematic view showing a right hamstring stretch using stretching and exercise device 200 of the third embodiment of the invention. The configuration of device 200 for performing stretch exercises, including the stretch exercises shown in FIGS. 8 and 9, is as shown in FIG. 10 in which device 100 is unpacked or released from housing 220 and lids 220A, 220B are closed with zipper 220C by folding lids 220A, 220B in directions of arrows R1, R2, respectively, shown in FIG. 7.

To perform the right calf stretch shown in FIG. 8, user 32 positions the right foot on resting strap 132 and surface 220E of lid 220A and rests the ankle on the resting strap 130. It will be appreciated that in this configuration, housing 220, on which resting strap 132 is securely connected, provides a base for the right foot during the stretch exercise. Then, while sitting upright and positioning the left foot as shown in FIG. 8, user 32 grips handle strap 138 (138C in FIG. 6A) with the right hand and handle strap 112 with the left hand. User 32 then pulls handle strap 138 to fully stretch the calf and the plantar foot muscles while pulling tight the remaining parts of device 200 using handle strap 112. It will be appreciated that by the construction of device 200 according to the present invention, the pulling action on handle strap 138 during the stretch exercise shown in FIG. 8 facilitates the isolation of the calf and plantar muscles for an effective isolated stretch.

To perform the right hamstring stretch shown in FIG. 9, device 200 is harnessed under the heel of the foot and behind the ankle by positioning the right foot on resting strap 132 and surface 220*e* of lid 220*a* and resting the ankle on resting strap 130. As described above with reference to FIG. 8, housing 220 provides a base for the right foot during the stretch exercise. Thereafter, while laying down, user 32 grips handle strap 112 with both hands and pulls up the right leg to obtain a stretch of the right hamstring and hip muscle. By varying the angle of the pull, user 32 can also stretch the lateral and medial muscles of the right leg.

It will be appreciated from the construction of device 200 according to the present invention, that during the stretch exercise shown in FIG. 9, resting straps 130, 132 are disposed at an angle relative to one another in which the ankle and foot are cradled to facilitate a stretching that isolates the hamstring and hip muscles from the calf muscles. Preferably, the angle between resting straps 130, 132 during the stretch exercise shown in FIG. 9 is in the range of about 50 degrees to about 130 degrees, and more preferably about 90 degrees.

In the foregoing stretch exercises illustrated in FIGS. 8-9 using stretching and exercise device 200 according to the third embodiment of the invention, resistance members 110, 120, 140 advantageously soften and smoothen the stretching motion and provide a dampening effect for a smoother, more effective stretch exercise, as described above for resistance members 18, 20 in the embodiment of FIGS. 1A-3B. More specifically, these resistance members allow for a mild stretch of device 200 so that as user 32 pulls handle strap 112 and/or handle strap 138 to stretch, the end of the stretch is softened to thereby reduce overall pain and tension. Additionally, resistance members 110, 120, 140 allow user 32 to push in with the foot into device 200 (e.g., by pressing against resting strap 132 and surface 220E of housing 220). After several seconds of using device 200, user 32 relaxes and returns to the stretch. This series of events fools the natural stretch reflex of the human body. The stretch reflex is a naturally built defense mechanism of the nervous system that prevents over-stretching of muscles while at the same time limiting the stretch range. It will be appreciated that the foregoing damping effect is applicable to all muscles of the body that can be stretched using device 200, including but not limited to all upper leg muscles, all lower leg muscles, all upper and lower arm muscles, and all shoulder muscles.

By the foregoing construction and operational modes, stretching and exercise device 200 according to the third embodiment of the present invention allows users to effectively perform stretching exercises correctly in a reliable and reproducible way. Additionally, stretching of hamstring and hip muscles usually requires the user to secure the assistance of another person. It will be appreciated by those skilled in the art that while performing the stretching exercise shown in FIG. 5, for example, device 200 allows user 32 to effectively stretch hamstring and hip muscles without any assistance. Thus, stretching and exercise device 200 according to the third embodiment is also particularly suitable for performing stretch exercises independently, such as in an unassisted physical therapy or exercise program.

The self-packing feature of device 220 according to the third embodiment of the invention will be explained below with reference to FIGS. 7, 10 and 11A-11C.

As described above, FIG. 10 shows device 200 in a configuration ready for use to perform stretching exercises, such as described above with reference to FIGS. 8-9, with housing 220 in a closed configuration that is achieved by folding lids 220A, 220B in the directions denoted by arrows R1, R2, respectively, as shown in FIG. 7, and closing zipper 220D. To store device 100 inside housing 220 from the configuration shown in FIG. 10, lids 220A, 220B are turned in respective directions opposite to the directions denoted by arrows R1, R2 as shown in FIG. 7 to open housing 220 as shown in FIG. 11A. Device 100 is then collapsed by folding its various parts one over another as shown in part in FIG. 11A. The collapse of device 100 is facilitated by various folding points F of device 100 as described above. While collapsing device 100, lids 220A, 220B of housing 220 are turned relative one another in respective directions denoted by arrows R1, R2 in FIG. 7 as shown in FIG. 11B. Zipper 220D is then closed as shown in FIG. 11C to store device 100 within housing 220. In the state shown in FIG. 11C, device 100 is entirely held and sealed inside housing 220. By this construction, the present invention provides a self-packing scheme by which the stretching and exercise device of the present invention packs into a small, portable package or case without the necessity for a separate carrying bag.

To unpack device 100 for a stretching exercise from the configuration shown in 11C, zipper 220D is opened to the configuration shown in FIG. 11A to expose device 100 so that device 100 can be pulled out. The lids 220A, 220B are then turned or pulled back relative one another in the direction denoted by arrows R1, R2 shown in FIG. 7 and zipper 220D is closed to place device 200 in the configuration shown in FIG. 10.

Devices 10 and 100 according to the first (FIGS. 1-5) and second (FIGS. 6A-6B) embodiments of the present invention do not exhibit the self-packing feature described above with reference to the third embodiment of FIGS. 7-11C. However, it will be appreciated by those skilled in the art that folding and collapsing of devices 10 and 100 according to the first and second embodiments can also be easily and readily accomplished by virtue of the flexible materials used and the various folding points as described above, and devices 10 and 100 can then be stored in a separate housing or casing.

While there have been described herein what are considered to be preferred embodiments of the present invention, other modifications of the invention will become apparent to those skilled in the art from the teaching herein. For example, instead of being manufactured from tubular nylon webbing, the various strap members of the stretching and exercise device according to the foregoing exemplary embodiments, including handle, connection and resting straps, may be manufactured of other materials such as polyester or high-strength plastics, and other configurations such as flat webbing may be utilized. Furthermore, the various components need not be stitched together as described, but could be attached one to the next by bonding, clamping or other suitable method. Additionally, the stretching and exercise device may be made in any dimension desired to accommodate a particular user or group of users.

It will be appreciated from the foregoing detailed description that the present invention provides a stretching and exercise device that is comfortable and safe to use, is inexpensive to manufacture, and has high portability by virtue of being easily stored and transported. As described in the exemplary embodiment of FIGS. 7-11C, the present invention also provides a self-packing scheme by which the stretching and exercise device of the present invention packs into a small, portable package or case without the necessity for a separate carrying bag.

By the stretching and exercise device of the present invention, proper stretching forms and techniques are easily practiced and correctly accomplished, and specific muscles and specific portions of the body can be particularly treated in an efficient and effective manner. For example, the stretching and exercise device of the present invention is particularly adapted for lower body muscle stretch, including the user's lower back and legs, and for isolating and exercising the foot/calf or hamstring/hip muscles in an efficient and effective manner. The stretching and exercise device of the present invention utilizes a damping mechanism to soften the stretching motion and minimize the stiffness and discomfort of the pulling during a stretching routine. The stretching and exercise device of the present invention is easy and comfortable to use and is adjustable to body size, and further facilitates injury prevention, strength training, and/or rehabilitation for foot/leg, hip and lower back muscles.

It should also be appreciated that the stretching and exercise device of the present invention incorporates exercises that treat and train the entire body. For example, FIGS. 4-5 and 8-9 demonstrate various exercises that help the user warm-up, stretch, strengthen the user's muscles, as well as treating the core muscles and providing a system for improving coordination. The stretching and exercise device of the present invention will also easily adapt from one exercise (e.g., FIG. 4) to the next (e.g., FIG. 5) quickly and efficiently.

While the present invention has been described in terms of specific embodiments, it is to be understood that the invention is not limited to these disclosed embodiments. This invention may be embodied in many different forms and should not be construed as limited to the embodiments set forth herein; rather, these embodiments are provided by way of illustration only and so that this disclosure will be thorough, complete and will fully convey the full scope of the invention to those skilled in the art. Indeed, many modifications and other embodiments of the invention will come to mind of those skilled in the art to which this invention pertains, and which are intended to be and are covered by both this disclosure, the drawings and the claims.

I claim:

1. A stretching and exercise device comprising:

a flexible first strap member having a pair of end portions;

a flexible second strap member having a pair of end portions;

a pair of elastic resistance members connected between respective end portions of the first and second strap members;

a flexible third strap member having a pair of end portions directly attached to respective end portions of the second strap member; and a flexible fourth strap member directly attached to a central surface portion of the second strap member disposed between the end portions thereof;

wherein the first strap member has at least one holding portion between the end portions thereof and configured to be gripped by a user's hand during a stretch exercise;

wherein the third strap member has a resting surface configured to be engaged by the user's ankle or a region of the user's wrist during the stretch exercise; and wherein the fourth strap member has a resting surface configured to be engaged by the user's foot or a region of the user's elbow during exercise.

2. A device according to claim 1; wherein the at least one holding portion comprises a plurality of holding portions configured to be gripped by the user's hand during a stretch exercise.

3. The device according to claim 1; wherein each of the first, second and third strap members is formed of tubular nylon webbing, the fourth strap member is made of ballistic nylon, and each of the resistance members is a bungee cord.

4. The device according to claim 1; wherein the first and third strap members are formed of a flexible tubular material; and further comprising a soft filler material disposed in the third strap member and in the at least one holding portion of the first strap member.

5. The device according to claim 1; further comprising a plurality of connectors connecting the resistance members to respective end portions of the first and second strap members.

6. The device according to claim 5; wherein each of the first, second and third strap members is formed of tubular nylon webbing, each of the connectors and the fourth strap member is made of ballistic nylon, and each of the resistance members is a bungee cord.

7. The device according to claim 5; wherein the first, second, third and fourth strap members and the connectors are formed of straps of flexible fabric material stitched together.

8. The device according to claim 7; wherein each of the first, second and third strap members is formed of tubular nylon webbing, each of the connectors and the fourth strap member is made of ballistic nylon, and each of the resistance members is a bungee cord.

9. A self-packing stretching and exercise device comprising:

a first strap member having a pair of end portions and being configured to be gripped by a user's hand during a stretch exercise;

a second strap member having a pair of end portions;

a pair of resistance members connected between respective end portions of the first and second strap members;

a third strap member having a pair of end portions attached to respective first and second surface portions of the second strap member, the third strap member being configured to be engaged by the user's ankle or a region of the user's wrist during a stretch exercise;

a fourth strap member attached to a third surface portion of the second strap member different from the first and second surface portions thereof, the fourth strap member being configured to be engaged by the user's foot or a region of the user's elbow during a stretch exercise; and a storage case dimensioned and configured in a closed configuration thereof to receive and completely store therein the first, second, third and fourth strap members and the resistance members, the storage case being integrally directly attached to only the fourth strap member so that in an open configuration of the storage case in which the first, second, third and fourth strap members and the resistance members are not stored therein, the storage case provides a base on which the user's foot or a region of the user's elbow rests during a stretch exercise.

10. The device according to claim 9; wherein the storage case comprises a first lid directly integrally attached to only the fourth strap member and a second lid pivotally attached to the first lid so as to be placed in a substantially horizontal position over the first lid both in the closed configuration of the storage case, in which the first, second, third and fourth strap members and the resistance members are completely stored within the storage case, and in the open configuration of the storage case, in which the first, second, third and fourth strap members and the resistance members are not stored in the storage case for use by the user to perform a stretch exercise.

11. A method of exercising muscles of the shoulder, comprising: placing a stretching and exercise device over a user's elbow corresponding to a first one of the user's arms and behind the user's neck by gripping the holding portion of the first strap member with one of the user's hand corresponding to the second of the user's arm so that a portion of the first arm proximate the wrist rests on the resting surface of the third strap member and a portion of the first arm proximate the elbow rests on the resting surface of the fourth strap member; and repeatedly pulling the holding portion of the first strap member with the one hand of the user in a direction away from the second, third and fourth strap members while generating resistance with the other of the user's hand via the resistance members to stretch the shoulder muscles, wherein the stretching and exercise device comprises: a flexible first strap member having a pair of end portions; a flexible second strap member having a pair of end portions; a pair of elastic resistance members connected between respective end portions of the first and second strap members; a flexible third strap member having a pair of end portions directly attached to respective end portions of the second strap member; and a flexible fourth strap member directly attached to a central surface portion of the second strap member disposed between the end portions thereof; wherein the first strap member has at least one holding portion between the end portions thereof and configured to be gripped by a user's hand during a stretch exercise; wherein the third strap member has a resting surface configured to be engaged by the user's ankle or a region of the user's wrist during the stretch exercise; and wherein the fourth strap member has a resting surface configured to be engaged by the user's foot or a region of the user's elbow during exercise.

12. A method of exercising the hamstring and hip muscles, comprising: placing a stretching and exercise device relative to a user's body so that the sole of one of the user's foot engages the resting surface of the fourth strap member and the user's ankle of the one foot engages the resting surface of the third strap member; and while the user lays down, repeatedly pulling up the user's leg corresponding to the one foot by gripping the holding portion of the first strap member with both hands of the user while generating resistance via the resistance members to stretch the hamstring and hip muscles, wherein the stretching and exercise device comprises: a flexible first strap member having a pair of end portions; a flexible second strap member having a pair of end portions; a pair of elastic resistance members connected between respective end portions of the first and second strap members; a flexible third strap member having a pair of end portions directly attached to respective end portions of the second strap member; and a flexible fourth strap member directly attached to a central surface portion of the second strap member disposed between the end portions thereof; wherein the first strap member has at least one holding portion between the end portions thereof and configured to be gripped by a user's hand during a stretch exercise; wherein the third strap member has a resting surface configured to be engaged by the user's ankle or a region of the user's wrist during the stretch exercise; and wherein the fourth strap member has a resting surface configured to be engaged by the user's foot or a region of the user's elbow during exercise.

13. A stretching and exercise device comprising: a flexible first handle strap having a pair of end portions; a pair of flexible first connecting straps each having a first and second end portion; a pair of elastic first resistance members, each being connected between one of the end portions of the first handle strap and the first end portion of the first connecting straps; a flexible first resting strap having a pair of end portions each directly attached proximate the first end portions of one of the first connecting straps; a flexible second resting strap connected directly between the second end portions of the first connecting straps; a flexible second connecting strap having one end portion directly attached to a central position of the first resting strap and another end portion directly attached to the second resting strap; a flexible third connecting strap having a pair of end portions each directly attached to an opposing end portion of the first handle strap; a flexible second handle strap having a first and second end portion wherein the first end portion is directly attached to a central portion of the third connecting strap; a flexible fourth connecting strap having first and second end portions wherein the first end portion is attached to the second resting strap opposite the second connecting strap; and an elastic second resistance member connected between the second end portion of the fourth connecting strap and the second end portion of the second handle strap.

14. The device according to claim 13; wherein each of the first handle strap and the second handle strap has a holding portion configured to be gripped by a user's hand during a stretch exercise; and wherein each of the first resting strap and the second resting strap has a resting surface on which selected parts of the user's body rest during a exercise.

15. The device according to claim 13; wherein each of the first handle strap, second handle strap, first connecting straps, second connecting strap, third connecting strap, fourth connecting strap, and first resting strap is formed of tubular nylon webbing, the second resting strap is made of ballistic nylon, and each of the first resistance members and the second resistance member is a bungee cord.

16. The device according to claim 13; further comprising a storage case integral with the second resting strap member and dimensioned to receive therein the first handle strap, second handle strap, first connecting straps, second connecting strap, third connecting strap, fourth connecting strap, first resting strap, first resistance members and second resistance member.

17. The device according to claim 13; further comprising a storage case having a first lid directly integrally attached to only the second resting strap and a second lid pivotally attached to the first lid so as to permit complete enclosure of the first handle strap, second handle strap, first connecting straps, second connecting strap, third connecting strap, fourth connecting strap, first resting strap, first resistance members and second resistance member within the storage case when the second lid is placed over the first lid.

* * * * *